United States Patent [19]

Slama

[11] Patent Number: 4,938,883

[45] Date of Patent: Jul. 3, 1990

[54] OVERBASED ALKALINE EARTH ALKENYL SUCCINATES AS A SILVER-MILD SOURCE OF ALKALINITY FOR HEAVY DUTY DIESEL ENGINES

[75] Inventor: Francis J. Slama, Montgomery, Ill.

[73] Assignee: Amoco Corporation, Chicago, Ill.

[21] Appl. No.: 237,151

[22] Filed: Aug. 26, 1988

[51] Int. Cl.[5] ..... C10M 105/22

[52] U.S. Cl. ..... 252/39; 252/56 R; 252/38

[58] Field of Search ..... 252/39, 38, 41, 51.5 A

[56] References Cited

U.S. PATENT DOCUMENTS

| | | | |
|---|---|---|---|
| 3,567,637 | 3/1971 | Sabol | 252/39 |
| 4,169,799 | 10/1979 | Sung | 252/42.7 |
| 4,171,269 | 10/1979 | Sung | 252/42.7 X |
| 4,278,553 | 7/1981 | Sung | 252/50 |
| 4,285,823 | 8/1981 | Sung | 252/50 |
| 4,320,016 | 3/1982 | Zoleski | 252/42.7 |
| 4,428,850 | 1/1984 | Zoleski | 252/42.7 |
| 4,464,276 | 8/1984 | Sung | 252/42.7 |
| 4,710,308 | 12/1987 | Stauffer | 252/427 |
| 4,734,211 | 3/1988 | Kennedy | 252/51.5 A |
| 4,764,296 | 8/1988 | Kennedy | 252/42.7 X |

*Primary Examiner*—William R. Dixon, Jr.
*Assistant Examiner*—James M. Hunter, Jr.
*Attorney, Agent, or Firm*—Matthew R. Hooper; William H. Magidson; Ralph C. Medhurst

[57] ABSTRACT

A silver-mild lubricant for use in heavy duty diesel engines which uses overbased alkaline earth long chain alkenyl succinate as a silver-mild source of alkalinity.

11 Claims, No Drawings

OVERBASED ALKALINE EARTH ALKENYL SUCCINATES AS A SILVER-MILD SOURCE OF ALKALINITY FOR HEAVY DUTY DIESEL ENGINES

TECHNICAL FIELD

This invention relates to a composition and method for improving the wear performance of silver-containing diesel engine parts. The invention is based on the discovery that overbased alkaline earth alkenyl succinates are a silver-mild source of alkalinity for heavy duty diesel lubricants.

BACKGROUND OF THE INVENTION

Heavy duty diesel engines require crankcase lubricant oils that contain additives which stabilize the oil against oxidation and which are non-corrosive to silver members of the engine. Oxidative deterioration is undesirable because it is accompanied by the formation of gum, sludge and acids which cause metal corrosion, chemical breakdown of the lubricant, and an increase in the viscosity of the lubricant. It is important that silver-containing connecting rod bearings and lead surfacing thereon are not attacked either by additives in the oil or by the oxidative, neutralized or decomposition products thereof during extended use.

High alkalinity in the lubricating oil is required to neutralize acidic combustion products and to extend the time intervals between oil changes. Also, the alkalinity life of the oil should be long in order to reduce the need to add alkalinity imparting additives before a complete change of the oil, and to reduce the frequency of oil changes. As is generally well known, most of the conventional, inexpensive sources of alkalinity, e.g., overbased phenate or sulfonate, are aggressive toward silver. This results in excessive wear of the silver-containing parts of the engine. The harshness of these overbased additives to silver has been attributed to the presence of carbonate, e.g., calcium carbonate, magnesium carbonate and the like.

Carbonate overbased additives can be tolerated in the lubricating oil by treating the oil with silver passivating or silver lubricity agents, e.g., chlorinated waxes and glycerol monooleate or pentaerythritol monooleate, as described in U.S. Pat. No. 4,734,211 to Kennedy. However, such silver lubricity agents can impart undesirable effects on the lubricating oil's performance. One such detrimental effect is oxidative thickening. Silver wear or lubricity agents are employed in spite of their undesirable side effects and cost because they allow the use of inexpensive alkalinity sources.

U.S. Pat. No. 3,567,637 to Sabol generally discloses the use of alkaline earth long chain alkenyl succinates as detergent additives for diesel oils. U.S. Pat. No. 4,710,308 to Stauffer generally discloses the use of overbased sulfurized phenates as antioxidants and dispersants. However, the silver-mildness of alkaline earth overbased polyalkenyl-substituted succinates when used in heavy duty diesel engines having silver parts in certain amounts is neither disclosed nor suggested.

U.S. Pat. No. 4,171,269 to Sung et al. teaches and claims a railway diesel engine lubricating oil composition having a TBN of at least 10 wherein the composition comprises a sulfurized normal or highly overbased calcium alkylphenolate detergent-inhibitor, a highly overbased alkaline earth metal hydrocarbyl sulfonate, a sulfurized naphthenic lubricating oil incorporating from about 1 percent to about 6 percent by weight of elementary sulfur and from 0.05 weight percent to 5 weight percent of a chloroparaffin wherein there is contained in combined form from 40 percent to 60 percent by weight of chlorine. The sulfurized naphthenic lubricating oil additive preferably contains a sulfurized lard oil formed essentially of triglycerides of $C_{12}$ to $C_{20}$ fatty acids and containing preferably triglycerides of myristic, palmitic and stearic, oleic and linoleic in concentrations of 1, 26, 11.5, 58 and 3.5 weight percent, respectively. The amount of chloroparaffin present will correlate generally with the amount of calcium sulfonate and be within the range of from 0.05 weight percent to 5 weight percent of the total lubricant composition. Silver wear properties were poor for formulations not containing both the chloroparaffin additive and the sulfurized naphthenic oil.

U.S. Pat. No. 4,278,553 to Sung et al. teaches and claims a railway diesel engine lubricant containing a silver corrosion inhibitor comprising a benzotriazole compound present in concentrations from about 0.5 to 2.0 weight percent. Examples of silver corrosion inhibitors include benzotriazole derivatives of N-alkyl-3-propanediamines.

U.S. Pat. No. 4,169,799 to Sung et al. discloses a combination of components consisting of an overbased alkaline earth metal containing alkyl phenolate sufficient to impart a TBN of at least 10 alkylphenol and a chlorinated sulfurized alkylphenol in a mineral oil base stock. The chlorinated alkylphenol is present in an amount of from 0.25 to 20 weight percent.

U.S. Pat. No. 4,285,823 to Sung et al. discloses a silver corrosion inhibitor for railway diesel engines lubricants comprising an N-alkylaminomethyl-5-amino-1H-tetrazole. The diesel lubricant contains the additive in an amount of from 0.5 to 2.0 weight percent.

Use of chlorinated hydrocarbons as silver wear inhibitors in railway diesel engine oils is also taught in U.S. Pat. Nos. 4,320,016 to Zoleski et al.; 4,428,850 to Zoleski et al. and 4,464,276 to Sung et al.

U.S. Pat. No. 4,734,211 to Kennedy discloses the use of lubricating oil compositions to provide silver wear inhibition and alkalinity reserve. The composition includes an overbased alkaline earth metal alkylphenolate, an alkaline earth metal alkylsulfonate, an overbased alkaline earth metal phenolate, a chlorinated hydrocarbon and a polyhydroxy compound such as glycerol monooleate.

In the above-mentioned patents, lubricant compositions useful as railway diesel engine lubricants are those containing substantially normal and/or highly overbased alkaline earth metal sulfurized alkylphenolate and highly overbased alkaline earth metal sulfonate additives generally having a TBN of at least 10 (Kennedy has a TBN of at least 5) and thus capable of preventing corrosion by oil-soluble acids formed by oxidative deterioration under normal engine use. If a sulfurized naphthenic oil-containing composition having a sufficient sulfur content is present with the foregoing overbased additives, the corrosion of the silver-plated bearings by the overbased alkaline earth metal alkylphenolate is overcome but not the similarly destructive properties of the alkaline earth metal sulfonate. Nevertheless, the incorporation of an alkaline earth metal sulfonate in these lubricant oils is desirable because of the improved engine performance provided over an extended period of time.

In addition, it is generally well known that zinc containing wear inhibitors such as the zinc dihydrocarbyldithiophosphate wear inhibitors, while commonly used in passenger car crankcase lubricants, cannot be tolerated in diesel engines containing silver parts and bearings because the zinc dithiophosphates are harmful to silver. Diesel engine lubricants, in particular railway diesel lubricants, therefor do not contain zinc dithiophosphate wear inhibitors. The antagonism of zinc containing wear inhibitors toward silver parts is mentioned in U.S. Pat. No. 4,428,850, column 1, lines 63–68.

As already noted, chlorinated hydrocarbons have been incorporated into railway diesel engine lubricant compositions to provide silver protection properties to the lubricant compositions. However, from an environmental standpoint it is generally preferred to reduce or eliminate altogether the use of chlorinated compounds in railway diesel engine lubricants.

An object of the present invention is therefore to provide a lubricating composition and method suitable for lubricating diesel engines having silver parts, such composition incorporating a species of overbased alkaline earth compound which is sufficiently mild toward the silver parts of the engine whereby silver lubricity agents, in particular those containing chlorine, may be avoided or substantially reduced. Other objects appear hereinafter and will become evident to the person of ordinary skill in the art.

SUMMARY OF THE INVENTION

In furtherance of the above objects, the present invention is a lubricating oil composition with silver-mild alkalinity for use in heavy duty diesel engines having silver parts, the composition being essentially free of zinc dihydrocarbyldithiophosphate wear inhibitors and comprising an overbased alkaline earth long chain alkenyl succinate and having a TBN of at least about 5.

As a method, the present invention is directed to a method for providing silver-mild lubrication in a diesel engine containing silver parts, which comprises the step of lubricating internal portions of said engine with a lubricating composition which (a) is essentially free of zinc dihydrocarbyldithiophosphate wear inhibitors; (b) has a total base number of at least about 5; and (c) comprises an overbased alkaline earth long chain alkenyl succinate in an amount in the range of about 0.5 to about 20% by weight of the lubricating composition.

The present invention is premised on the unexpected discovery that overbased alkaline earth long chain alkenyl succinates are a much more silver-mild source of alkalinity than the types of overbased detergents typically employed in heavy duty formulations such as, for example, the overbased calcium phenates or magnesium sulfonates which are known to be very aggressive toward silver components. A principal advantage in using the overbased succinates as a silver-mild source of alkalinity is the ability to substantially reduce or eliminate altogether silver lubricity agents such as chlorinated waxes or the partial glycerol esters of oleic acid. The reduction or elimination of such silver lubricity agents contributes to cost efficiency as well as to the avoidance of oxidative thickening which can result from the silver lubricity agents.

For purposes of this invention the term "silver lubricity agent" is intended to denote any lubricant additive compound, the primary purpose of which is to reduce or ameliorate the harmful effects upon silver parts caused by overbased alkalinity-providing detergents used in heavy duty lubricant formulations.

Due to the unexpected silver-mildness of the overbased succinates prescribed for use herein, the invention is further directed to lubricant compositions and lubrication methods which reduce or eliminate the use of silver lubricity agents.

It should also be pointed out that the exclusion of zinc dialkyldithiophosphate wear inhibitors from the compositions and methods of the present invention is critical insofar as the zinc containing compounds are antagonistic to silver parts and cannot be used in the type of lubrication environment (i.e., heavy duty diesel engines having silver parts and requiring high alkalinity) contemplated by the present invention. For purposes of the present invention, the term "essentially free of zinc dihydrocarbyldithiophosphate wear inhibitors" is intended to exclude amounts thereof having any measurable detrimental effect upon silver components.

DETAILED DESCRIPTION OF THE PREFERRED EMBODIMENTS

While this invention is susceptible to embodiments in many different forms, preferred embodiments of the invention are disclosed. It should be understood, however, that the present disclosure is to be considered as an exemplification of the principles of this invention and is not intended to limit the invention of the embodiments illustrated.

As utilized herein, the term "overbased" refers to the contribution of carbonate to the Total Base Number (TBN) of the additive being greater than about 150 mg KOH/g of sample.

This method of the present invention provides improved wear performance of silver-containing components within heavy duty diesel engines. In this invention, an overbased polyalkenyl-substituted dicarboxylate, e.g., an overbased alkaline earth long chain alkenyl succinate, is utilized as an oil-soluble additive which provides alkalinity to a lubricating base material. The succinate can be derived from succinic anhydride or succinic acid. The resulting lubricating oil composition, being overbased, neutralizes acidic combustion products formed in an internal combustion engine and is silver-mild.

The additives useful in the present invention are overbased using suitable basic alkaline earth metal compounds which are commonly known and include the oxides and hydroxides of barium, strontium, calcium and magnesium to produce an alkaline earth metal salt of a polyalkenyl-substituted dicarboxylate.

Illustrative examples of overbased additives suitable for use in the present invention are overbased alkaline earth polyalkenyl-substituted dicarboxylates, e.g., polybutenyl succinic acid, polypropenyl succinic acid, and the like.

Further illustrations and a method of producing the same are disclosed in U.S. Pat. No. 3,567,637 to Sabol which is incorporated herein by reference.

The overbased alkaline earth polyalkenyl-substituted dicarboxylates have a number average molecular weight in the range of about 300 to about 2200, preferably about 350 to about 500. The polyalkenyl moiety contains about 20 to about 160 carbon atoms, preferably about 25 to about 40 carbon atoms.

The alkalinity of the additives suitable for use in the present invention can also be expressed as the total base number (TBN). The term "total base number" or "TBN" is defined as the quantity of acid, expressed in terms of the equivalent number of milligrams of potassium hydroxide, that is required to neutralize all basic constituents present in one gram of a given sample. The method of evaluation is ASTM Method D-2896. The TBN of the additive is at least about 5, preferably at least about 100.

The concentration of the overbased additive in the lubricating base material is about 0.5 to about 20 weight percent, and preferably about 1.5 to about 10 weight percent based on the total weight of the lubricating oil composition.

Optionally, a silver lubricating agent can be utilized in conjunction with these additives; however, due to the silver mildness of the alkalinity-producing additives of the present invention, much less of said optional agent can be used as compared to prior art levels. Thus, the weight percent of the optional silver lubricity agent in lubricating base material is less than about 0.5 weight percent based on the total weight of the lubricating oil composition.

The lubricating base material can be of synthetic, animal, vegetable or mineral origin. Ordinarily, mineral lubricating oils are preferred. Other additives can be in the lubricating base material as well. Such additives include, e.g., viscosity index improving agents, pour point depressing agents, anti-foam agents, extreme pressure agents, and rust and corrosion inhibiting agents.

Tests were conducted to evaluate the present invention as a method of minimizing silver-wear in heavy duty diesel engines.

The silver antagonism of various lubricating oil compositions was tested using an Amoco modified Silver Disc Wear Test. This wear test procedure is a laboratory test for determining the anti-wear properties of a lubricant oil. The test machine comprises a system wherein a one-half inch diameter steel ball is placed in an assembly with three one-fourth inch silver discs of like size and of a quality identical to that employed in the plating of the silver pin insert bearing of railway diesel engines manufactured by the Electromotive Division (EMD) of General Motors, Inc. These discs are in a fixed triangular position in a reservoir containing the oil sample to be tested for its silver anti-wear properties. The steel ball is positioned above and in contact with the three silver discs. In carrying out these tests, the ball is rotated while it is pressed against the three discs at the pressure specified and by means of a suitable weight applied to a lever arm. The test results are determined by using a low power microscope to examine and measure the scars on the discs. A wear scar diameter of 2 mm or less is considered to indicate adequate silver-wear protection. The rotation of the steel ball on the silver discs proceeds for a period of 30 minutes at 600 revolutions per minutes under a 23 kilogram static load. Each lubricating oil composition was tested at a temperature of 350° F.

The lubricating oil compositions studied and their respective test results for reduction of silver-wear are described in Tables IA, IB, IC and II below.

TABLE IA

Compositions Containing Two Silver Lubricity Agents and Silver Disc Wear Test Results

| Component, wt. % | Composition A1 | A2 | A3 |
|---|---|---|---|
| Base oil blend | 88.06 | 88.06 | 88.06 |

TABLE IA-continued

Compositions Containing Two Silver Lubricity Agents and Silver Disc Wear Test Results

| Component, wt. % | Composition A1 | A2 | A3 |
|---|---|---|---|
| Other additives[1] | 9.45 | 9.45 | 9.45 |
| Glycerol monooleate[2] | 0.40 | 0.40 | 0.04 |
| Chlorinated wax[3] | 0.09 | 0.09 | 0.09 |
| Alkalinity Source[4] | | | |
| 250-TBN Calcium Phenate | 2.00 | 0.90 | 0.90 |
| 250-TBN Overbased Calcium Succinate[5] | 0.00 | 1.10 | 0.00 |
| 250-TBN Overbased Magnesium Succinate[6] | 0.00 | 0.00 | 1.10 |
| Total Percent | 100.00 | 100.00 | 100.00 |
| | Silver Disc Wear | | |
| Silver Wear Test Results, mm | 1.3 | 1.0 | 1.1 |

[1]Finished oil contains ca.: 2.7% Mannich dispersant, 4.8% calcium Mannich phenolate and 2.0% low base calcium sulfonate.
[2]A known silver lubricity agent, see U.S. Pat. No. 4,734,211.
[3]Chlorowax 80E, from Keil Chemical Division, Ferro Corp., Hammond, IN, a commercially available silver lubricity agent.
[4]Providing 5 TBN units to finished oil.
[5]Made from a ca. 1300 molecular weight polyisobutenyl succinic acid.
[6]Made from a ca. 1000 molecular weight polyisobutenyl succinic acid.

TABLE IB

Compositions Containing One Silver Lubricity Agent and Silver Disc Wear Test Results

| Component, wt. % | A4 | A5 | A6 | A7 |
|---|---|---|---|---|
| | Composition | | | |
| Base oil blend | 88.35 | 88.35 | 88.35 | 88.35 |
| Other additives[1] | 9.45 | 9.45 | 9.45 | 9.45 |
| Glycerol monooleate[2] | 0.20 | 0.20 | 0.20 | 0.20 |
| Alkalinity Source[3] | | | | |
| 250-TBN Overbased Calcium Phenate | 2.00 | 0.00 | 0.00 | 0.00 |
| 250-TBN Overbased Calcium Succinate[4] | 0.00 | 2.00 | 0.00 | 0.00 |
| 250-TBN Overbased Calcium Succinate[5] | 0.00 | 0.00 | 2.00 | 0.00 |
| 250-TBN Overbased Magnesium Succinate[6] | 0.00 | 0.00 | 0.00 | 2.00 |
| Total Percent | 100.00 | 100.00 | 100.00 | 100.00 |
| | Silver Disc Wear | | | |
| Silver Wear Test Results, mm | 2.4 | 0.9 | 1.2 | 1.3 |

[1]Finished oil contains ca.: 2.7% Mannich dispersant, 4.8% calcium Mannich phenolate and 2.0% low base calcium sulfonate.
[2]A known silver lubricity agent, see U.S. Pat. No. 4,734,211.
[3]Adjusted to provide 5 TBN units to finished oil.
[4]Made from a ca. 1300 molecular weight polyisobutenyl succinic acid.
[5]Made from a ca. 1000 molecular weight polyisobutenyl succinic acid.

TABLE IC

Compositions Containing No Silver Lubricity Agent and Silver Disc Wear Test Results

| Component, wt. % | A8 | A9 | A10 | A11 |
|---|---|---|---|---|
| | Composition | | | |
| Base oil blend | 88.55 | 88.55 | 88.55 | 88.55 |
| Other additives[1] | 9.45 | 9.45 | 9.45 | 9.45 |
| Alkalinity Source[2] | | | | |
| 250-TBN Overbased Calcium Phenate | 2.00 | 0.00 | 0.00 | 0.00 |
| 250-TBN Overbased Calcium Succinate[3] | 0.00 | 2.00 | 0.00 | 0.00 |
| 250-TBN Overbased Calcium Succinate[3] | 0.00 | 0.00 | 2.00 | 0.00 |
| 250-TBN Overbased Magnesium Succinate[3] | 0.00 | 0.00 | 0.00 | 2.00 |
| Total Percent | 100.00 | 100.00 | 100.00 | 100.00 |
| | Silver Disc Wear | | | |

TABLE IC-continued

| Compositions Containing No Silver Lubricity Agent and Silver Disc Wear Test Results | | | | |
|---|---|---|---|---|
| Component, wt. % | A8 | A9 | A10 | A11 |
| Silver Wear Test Results, mm | 2.8 | 1.3 | 1.4 | 1.6 |

[1]Finished oil contains ca.: 2.7% Mannich dispersant, 4.8% calcium Mannich phenolate and 2.0% low base calcium sulfonate.
[2]Providing 5 TBN units to finished oil.
[3]Made from a ca. 1000 molecular weight polyisobutenyl succinic acid.

The results clearly show the efficacy of the present method when a silver lubricity agent is present, and, more surprisingly, the efficacy of the present method when a silver lubricity agent is not present in the lubricating oil composition.

As shown in Table IA, the performances of A2 and A3 are better than the 1.3 mm test phenate control composition of A1. This is so in spite of both A2 and A3 containing 0.9 weight percent of a phenate alkalinity imparting additive which is known to be detrimental to silver-containing parts.

Additionally, the overbased succinates furnish about 2.8 TBN units to the finished oils. Therefore, the present method provides a desirable alkalinity source which is silver-mild.

In Table IB, the concentration of silver lubricity agents has been reduced as compared to Table IA. The chlorinated wax has been eliminated and the concentration of the glycerol monooleate has been reduced by 50%. However, the test results of compositions A5, A6 and A7 compare favorably with those obtained for compositions A2 and A3 of Table IA and are significantly better than the 2 mm test standard and are much better than the 2.4 mm wear scar obtained using the phenate oil of composition A4. Thus, satisfactory results are obtained while reducing the level of silver lubricity agent present. Reduction of the levels of the silver lubricity agent is beneficial because of their undesirable affects on certain oil performance aspects such as oxidative thickening.

Furthermore, compositions A5, A6 and A7 furnish about 5 TBN units to the finished oil. Here again it is demonstrated that the present method provides a desirable alkalinity source which is silver-mild.

Compositions wherein no silver lubricity agent is utilized and test results therefor are presented in Table IC. The wear scar of compositions A9, A10 and A11 are still well below the 2 mm test standard, and they are much better than the 2.8 mm wear scar obtained with formulation A8 which contains the overbased additive usually used in the art. Thus, the silver lubricity agent can be eliminated with elimination of its undesirable affects.

Furthermore, compositions A9, A10 and A11 furnish about 5 TBN units to the finished oils. Therefore, the present method provides a desirable alkalinity source which is silver mild.

Table II, below, presents a further comparison of Silver Disc Test results for compositions presented in Table II.

TABLE II

| | Comparison of Alkalinity Sources | | | | | | | |
|---|---|---|---|---|---|---|---|---|
| | A12 | A13 | A14 | A15 | A16 | A17 | A18 | A19 |
| Component, wt. % | Composition | | | | | | | |
| Base oil blend | 84.50 | 85.20 | 85.00 | 85.00 | 84.10 | 84.41 | 84.07 | 82.80 |
| Dispersant[1] | 3.00 | 3.00 | 3.00 | 3.00 | 3.00 | 3.00 | 3.00 | 3.00 |
| Low-Base Calcium Phenate[2] | 8.00 | 8.00 | 8.00 | 8.00 | 8.00 | 8.00 | 8.00 | 8.00 |
| Calcium Mannich Phenolate | 2.00 | 2.00 | 2.00 | 2.00 | 2.00 | 2.00 | 2.00 | 2.00 |
| Chlorinated Wax[3] | 0.50 | 0.50 | 0.50 | 0.50 | 0.50 | 0.50 | 0.50 | 0.50 |
| Alkalinity Source[4] | | | | | | | | |
| 300-TBN Calcium Sulfonate | 2.00 | | | | | | | |
| 450-TBN Calcium Sulfonate | | 1.30 | | | | | | |
| 400-TBN Magnesium Sulfonate | | | 1.50 | | | | | |
| 400-TBN Magnesium Sulfonate | | | | 1.50 | | | | |
| 250-TBN Calcium Phenate | | | | | 2.40 | | | |
| 286-TBN Calcium Succinate | | | | | | 2.09 | | |
| 247-TBN Calcium Succinate | | | | | | | 2.43 | |
| 167-TBN Magnesium Succinate | | | | | | | | 3.70 |
| Total Percent | 100.00 | 100.00 | 100.00 | 100.00 | 100.00 | 100.00 | 100.00 | 100.00 |
| Test results, mm | Silver Disc Wear | | | | | | | |
| Test 1 | 2.57 | 2.91 | 2.29 | 2.28 | 2.63 | 1.48 | 1.77 | 1.40 |
| Test 2 | 2.56 | — | 2.32 | — | 2.59 | 1.60 | 1.92 | — |
| Test 3 | 2.67 | — | — | — | 2.72 | 1.63 | — | — |

[1]A Mannich dispersant.
[2]A 125 TBN non-overbased phenate.
[3]Chlorowax 80E, Keil Chemical Division, Ferro Corp., Hammond, IN, a commercially available silver lubricity agent.
[4]Providing about 6 TBN units to the finished oil.

The compositions suitable for use in the method of the present invention are compositions A17, A18 and A19. These compositions provided the best silver wear protection and are the only ones which passed the Silver Disc Wear Test based on the 2.0 mm silver wear scar diameter standard. Thus compositions A17–A19 exhibit superior silver-mildness as compared to the compositions A12–A16. The compositions A12–A16 would cause excessive wear in an engine even though the TBN was approximately that of the composition used in the present invention.

Thus, while the TBN of compositions A12–A19 were all adjusted to about 600 for every 100 grams of the composition, only the compositions suitable for use in the present invention, A17–A19, provide satisfactory silver mildness.

The composition of the present invention has no adverse effect on oil performance in oil thickening tests. This oil thickening test is conducted by placing 100 grams of a test oil and polished lead and copper coupons in a test tube. The test tube is then sparged with air and held at 325° F. for the duration of the test. Samples of the test oil are evaluated for viscosity increase relative to the original test oil. Results are reported as a percentage viscosity increase. The lower the percent viscosity increase, the better the oil thickening test (OTT) performance.

Compositions studied and their respective test results of the oxidative thickening test are described in Table III and Table IV below.

TABLE III

Oxidative Thickening Test[1]
Compositions and Results

| | A20 | A21 |
|---|---|---|
| | Compositions | |
| Component, wt. % | | |
| Base oil blend | 88.31 | 88.50 |
| Other additives[2] | 9.70 | 9.70 |
| Glycerol monooleate[3] | 0.40 | 0.30 |
| Chlorinated wax[3] | 0.09 | 0.00 |
| A 250 TBN Overbased Calcium Phenate | 1.50 | 0.00 |
| A 250 TBN Overbased Calcium Succinate[5] | 0.00 | 1.50 |
| Total Percent | 100.00 | 100.00 |
| Time, hour | Percent Viscosity Increase | |
| 72 | 110 | 50 |
| 96 | 900 | 120 |
| 120 | TV[7] | 370 |

[1]The tests were conducted under the following conditions, 325° F., air sparge, Cu/Pb catalyst.
[2]Finished oil contains ca.: 2.7% Mannich dispersant, 4.8% calcium Mannich phenolate and 2.0% low base calcium sulfonate.
[3]A silver lubricity agent, see U.S. Pat. No. 4,734,211.
[4]Chlorowax 800E, Keil Chemical Division, Ferro Corp., Hammond, IN, a commercially available silver lubricity agent.
[5]Made from a ca. 1000 molecular weight polyisobutenyl succinic acid.
[6]Too viscous to measure.

TABLE IV

Oxidative Thickening Test[1]
Silver Disc Wear Test and ASTM D-664
TBN Test-Compositions and Results

| | A22 | A23 |
|---|---|---|
| | Compositions | |
| Component, wt. % | | |
| Base oil blend | 89.0 | 89.2 |
| Other additives[2] | 9.7 | 9.7 |
| Chlorinated wax[3] | 0.09 | 0.00 |
| Glycerol monooleate[4] | 0.40 | 0.30 |
| 250 TBN Overbased Calcium Phenate | 1.50 | 0.00 |
| 250 TBN Overbased Calcium Succinate[5] | 0.00 | 1.50 |
| Oil Thickening Test | Percent Viscosity Increase | |
| Time, hour | | |
| 72 | 110 | 41 |
| 96 | 900 | 81 |
| 120 | TV | 200 |
| Silver Wear Scar, mm | 1.12 | 1.10 |
| 120 Hour ASTM D-664 TBN | 4.0 | 6.9 |

[1]Tests were conducted under the following conditions, 325° F., air sparge, Cu/Pb catalyst.
[2]Finished oil contain: 2.8% Mannich dispersant, 4.8% calcium Mannich phenolate and 2.0% low base calcium sulfonate.
[3]Chlorowax 80E, Keil Chemical Division, Ferro Corp., Hammond, IN, a commercially available silver lubricity agent.
[4]A known silver lubricity agent, see U.S. Pat. No. 4,734,211.
[5]Made from a ca. 1000 molecular weight polyisobutenyl succinic acid.

TABLE V

EMD Test Results

| | Compositions | |
|---|---|---|
| | A24 | A25 |
| Component, wt. % | | |
| Base oil blend | 88.9 | 89.10 |
| Other additives[1] | 9.0 | 9.0 |
| Chlorinated wax[2] | 0.09 | 0.00 |

TABLE V-continued

EMD Test Results

| | Compositions | |
|---|---|---|
| | A24 | A25 |
| Glycerol monooleate[3] | 0.40 | 0.30 |
| 250 TBN Overbased Calcium Phenate | 1.60 | |
| 250 TBN Overbased Calcium Succinate[4] | 0.00 | 1.60 |
| EMD2-567D Results | | |
| Distress Demerits | | |
| Left Bearing | — | 6.0 |
| Right Bearing | — | 21.25 |
| Average (50 max.) | 15.25 | 13.62 |

[1]Finished oil contains ca. 2.8% Mannich dispersant, 4.8% calcium Mannich phenolate and 2.0% low base calcium.
[2]Chlorowax 80E, Keil Chemical Division, Ferro Corp., Hammond, IN, a commercially available silver lubricity agent.
[3]A known silver lubricity agent, see U.S. Pat. No. 4,734,211.
[4]Made from a ca. 1300 molecular weight polyisobutenyl succinic acid.

The results in Table III indicate that the composition suitable in the present method, A21, gives satisfactory OTT results. Composition A21 does not cause oxidative thickening to the degree of composition A20 which lacks an overbased alkaline earth long chain alkenyl succinate of the present method.

The results in Table IV indicate that composition A23, the composition formulated with the overbased calcium succinate, has superior viscosity control, superior TBN retention and yet equal silver wear to formulation A22, the phenate composition, even though composition A23 has less silver wear agent. These OTT data, similar to those in Table III, show the detrimental effect of the chlorowax silver-wear agent on viscosity control and yet the chlorowax additive is required in the phenate composition A22 in order to control silver wear.

Table V shows the results for EMD2-567 tests comparing a railway diesel oil formulated with an overbased calcium succinate to a typical phenate based railway diesel lubricating oil. The EMD2-567 test is a well-known test in which a diesel engine, a two cylinder (1134 CID) segment of a naturally aspirated railway diesel engine, is run for 25 hours. Wear is measured on the silver connecting rod bearing inserts. Wear is measured in demerits. An average of 50 or less demerits with neither of the two bearings having 50 or more demerits is considered a passing result.

Table V demonstrates that the silver wear protection provided by the overbased calcium succinate formulation A25 is superior to the standard phenate formulation A24 in an actual diesel engine test specifically designed to evaluate silver wear. Additionally, the succinate oil composition A25 was formulated with less silver wear protection agent than the A24 composition and in particular with no chlorowax additive.

This invention has been described in terms of specific embodiments set forth in detail, but it should be understood that they are by way of illustration only and that the invention is not necessarily limited thereto. Modifications and variations will be apparent from this disclosure and may be resorted to without departing from the spirit from the invention, as those skilled in the art will readily understand. Accordingly, such variations and modifications of the disclosed products are considered to be within the purview and scope of this invention and the following claims.

We claim:

1. A method for providing silver-mild lubrication in a diesel engine containing silver parts which method comprises the step of lubricating internal portions of said engine with a lubricating composition which (a) has a total base number of at least about 5; and (b) comprises an overbased alkaline earth long chain alkenyl succinate in an amount in the range of about 0.5 to about 20% by weight of the lubricating composition.

2. The method in accordance with claim 1 wherein the overbased succinate is present in an amount in a range of about 0.5 to about 10 percent by weight of the lubricating oil composition.

3. The method in accordance with claim 1 wherein the total base number of the succinate is at least about 100.

4. The method in accordance with claim 1 wherein the number average molecular weight of the succinate is in a range of about 300 to about 2200.

5. The method in accordance with claim 1 wherein the alkenyl moiety contains about 20 to about 160 carbon atoms.

6. The method in accordance with claim 5 wherein the number average molecular weight of the succinate is in the range of about 300 to about 2200 and the alkenyl moiety thereof contains about 20 to about 60 carbon atoms.

7. A method for providing silver-mild lubrication in a heavy duty diesel engine containing silver parts which comprises lubricating internal portions of said engine with a lubricating oil composition which (a) has a total base number of at least 5; and (b) comprises an overbased alkaline earth long chain alkenyl succinate in an amount in the range of about 0.5 to about 20 percent by weight of the lubricating oil composition, said oil composition being formulated without silver lubricity agents.

8. A method for providing silver-mild lubrication in a heavy duty diesel engine containing silver parts which comprises lubricating internal portions of said engine with a lubricating oil composition which (a) has a total base number of at least 5; and (b) comprises an overbased alkaline earth long chain alkenyl succinate in an amount in the range of about 0.5 to about 20 percent by weight of the lubricating oil composition wherein said oil composition is formulated with substantially reduced amounts of silver lubricity agents.

9. The method of claim 8 wherein said substantially reduced silver lubricity agent is a chlorinated compound and is present in the lubricating oil in an amount less than about 0.5 wt. %.

10. The method of claim 8 wherein said substantially reduced silver lubricity agent is glycerol monooleate and is present in the lubricating oil in an amount less than about 0.5 wt. %.

11. The method of claim 8 wherein said substantially reduced silver lubricity agent is a mixture of chlorowax and glycerol monooleate.

* * * * *